US008186781B2

(12) United States Patent
Coleman et al.

(10) Patent No.: US 8,186,781 B2
(45) Date of Patent: May 29, 2012

(54) ARTICULATED HINGES USING NON-CIRCULAR GEARS

(75) Inventors: Joseph Lee Coleman, Evansville, IN (US); Alan S. Lucas, Evansville, IN (US); Harish Kulkarni, Pune (IN); Ralph Tate, Jr., Evansville, IN (US); Bozhi Yang, Portland, OR (US)

(73) Assignee: Whirlpool Corporation, Benton Harbor, MI (US)

( * ) Notice: Subject to any disclaimer, the term of this patent is extended or adjusted under 35 U.S.C. 154(b) by 397 days.

(21) Appl. No.: 12/437,033

(22) Filed: May 7, 2009

(65) Prior Publication Data

US 2010/0283367 A1 Nov. 11, 2010

(51) Int. Cl.
*A47B 96/04* (2006.01)

(52) U.S. Cl. ..... 312/405; 312/326; 16/354; 16/362

(58) Field of Classification Search ..... 312/405, 312/326, 329, 319.2; 16/354, 362, 364, 239
See application file for complete search history.

(56) References Cited

U.S. PATENT DOCUMENTS

| | | | | |
|---|---|---|---|---|
| 283,416 | A | 8/1883 | Pattison | |
| 2,067,042 | A | 1/1937 | Bloom | |
| 2,078,815 | A | 4/1937 | Segar | |
| 2,206,739 | A * | 7/1940 | Brogren et al. | 16/354 |
| 2,215,170 | A * | 9/1940 | Carroil | 49/249 |
| 2,516,935 | A | 8/1950 | Weaver | |
| 2,890,476 | A | 6/1959 | Lustig | |
| 2,975,013 | A | 3/1961 | Wallace et al. | |
| 3,016,261 | A | 1/1962 | Tatter | |
| 3,422,487 | A | 1/1969 | Dickinson et al. | |
| 4,411,046 | A * | 10/1983 | Nawrath | 16/354 |
| 4,516,813 | A | 5/1985 | Sekerich | |
| 4,584,738 | A | 4/1986 | Lautenschlager | |
| 4,609,234 | A | 9/1986 | Naniwa et al. | |
| 4,765,027 | A | 8/1988 | Andric | |
| 4,979,265 | A * | 12/1990 | Grass | 16/291 |
| 5,040,857 | A * | 8/1991 | Mandel et al. | 312/405 |
| 5,102,084 | A | 4/1992 | Park | |
| 5,500,985 | A | 3/1996 | Klueger | |
| 5,535,482 | A * | 7/1996 | Grabber | 16/286 |
| 5,762,412 | A * | 6/1998 | Kim | 312/319.2 |
| 6,191,937 | B1 | 2/2001 | Bang | |
| 6,205,617 | B1 * | 3/2001 | Held et al. | 16/246 |
| 6,318,824 | B1 | 11/2001 | LaGrotta et al. | |
| 6,519,812 | B2 | 2/2003 | Ko et al. | |
| 6,591,454 | B2 | 7/2003 | Brustle | |
| 7,127,778 | B2 | 10/2006 | Salice | |
| 7,192,105 | B2 * | 3/2007 | Jung | 312/405 |
| 7,207,087 | B2 | 4/2007 | Salice | |
| 7,328,484 | B2 * | 2/2008 | Salice | 16/354 |
| 7,805,810 | B2 * | 10/2010 | Hoffman | 16/354 |
| 7,832,057 | B2 * | 11/2010 | Hoffman | 16/367 |
| 7,926,370 | B2 * | 4/2011 | Kawabuchi et al. | 74/22 R |
| 2005/0258724 | A1 | 11/2005 | Hwa Kim | |
| 2006/0232176 | A1 | 10/2006 | Kim et al. | |
| 2009/0241290 | A1 * | 10/2009 | Jones et al. | 16/291 |
| 2010/0109497 | A1 * | 5/2010 | Blersch et al. | 312/405 |
| 2010/0141107 | A1 * | 6/2010 | Kim et al. | 312/405 |
| 2010/0231111 | A1 * | 9/2010 | Kang et al. | 312/405 |
| 2010/0283367 | A1 * | 11/2010 | Coleman et al. | 312/405 |

* cited by examiner

*Primary Examiner* — Darnell Jayne
*Assistant Examiner* — Daniel Rohrhoff
(74) *Attorney, Agent, or Firm* — Kirk W. Goodwin; McKee, Voorhees & Sease

(57) ABSTRACT

A hinge for controlling the movement of a door on a refrigerator is disclosed, the hinge allowing the refrigerator to be installed flush to adjacent cabinets. The door translates and rotates in order to allow access to the refrigerator cabinet interior without contacting the adjacent cabinets.

26 Claims, 6 Drawing Sheets

ARTICULATED HINGES USING NON-CIRCULAR GEARS

FIELD OF THE INVENTION

The invention relates to a refrigerator having a novel hinge for a cabinet-depth mount. The invention also relates to a method for operating the hinge.

BACKGROUND OF THE INVENTION

In a traditional kitchen setting, appliances tend to extend out from the adjacent cabinets. There has been a growing trend towards a seamless appearance between appliances and cabinetry. However, contemporary refrigerators feature a door which is hinged on one or both sides and the refrigerator door pivots about this hinge. Because of this, a refrigerator must either protrude from the surrounding cabinetry to allow space for the door to open or there must be a gap between the refrigerator and the cavity in which the refrigerator sets. Neither of these alternatives is desirable given the goal of seamless integration of the refrigerator to the surrounding cabinetry. Therefore, there is a need for a refrigerator design which is capable of seamlessly and flushly aligning with surrounding cabinetry, while still allowing the refrigerator door to fully open.

Therefore, it is the object of the present invention to provide a refrigerator which may be installed flush to existing cabinetry without a noticeable gap between the cabinetry and the refrigerator.

It is a further object of the present invention to provide a refrigerator having a door which does not intrude upon the opening of the fresh food compartment.

It is a further object of the present invention to provide a refrigerator door hinge utilizing gears rather than linkages.

BRIEF SUMMARY OF THE INVENTION

The present invention is directed to an apparatus and method for accomplishing the tasks of translating and rotating the refrigerator door relative to the refrigerator compartment through the use of a mechanically operated hinge between the refrigerator compartment and the door. The refrigerator compartment may be either a fresh food compartment or a freezer compartment.

According to one preferred embodiment of the present invention, a number of elliptically shaped gears are used in combination with a timing mechanism, such as a Geneva mechanism. As the door is opened, the timing mechanism translates rotational force as the door is opened to the combination of elliptical gears, resulting in a translation of the refrigerator door away from the refrigerator compartment. Once the Geneva mechanism has reached a preferred angular orientation, the refrigerator door pivots about the final gear.

According to an alternative embodiment of the present invention, a planetary gear box is used, the door being attached to one of the planetary gears. As the door is opened, rotational force from the opening of the door causes the gears in the box to rotate relative to one another, resulting in translation of the door. The gear box is designed to ensure that the refrigerator door clears surrounding cabinetry.

DETAILED DESCRIPTION OF THE PREFERRED EMBODIMENT

The invention relates generally to an improved hinge for use with a refrigerator, the hinge designed so as to allow the refrigerator to be flushly mounted with adjacent cabinets with no noticeable gap between the refrigerator and the cabinets, the hinge opening the refrigerator door so that the door does not impact or damage the adjacent cabinets.

Figure 1A:
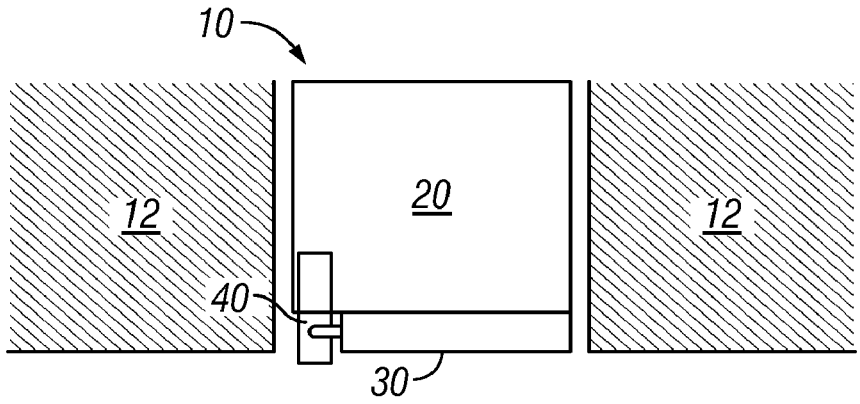
FIG. 1A is a top view showing a refrigerator with a first hinge design being mounted flush with the adjoining cabinets.
Figure 2A:
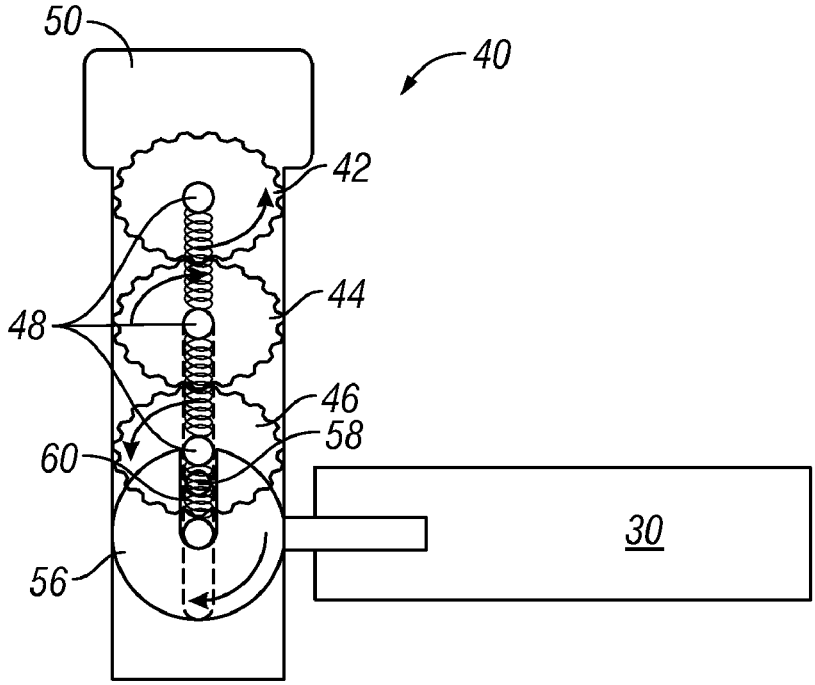
FIG. 2A is an enlarged view of the first hinge according to the preferred embodiment.
Figure 1B:
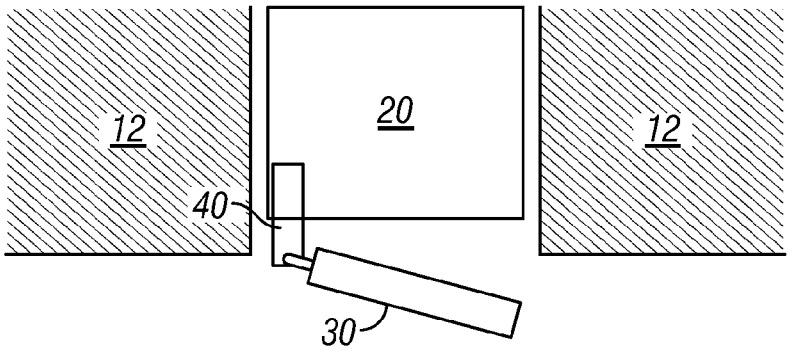
FIG. 1B is a top down view showing the refrigerator door partially opened and the hinge extended.
Figure 2B:
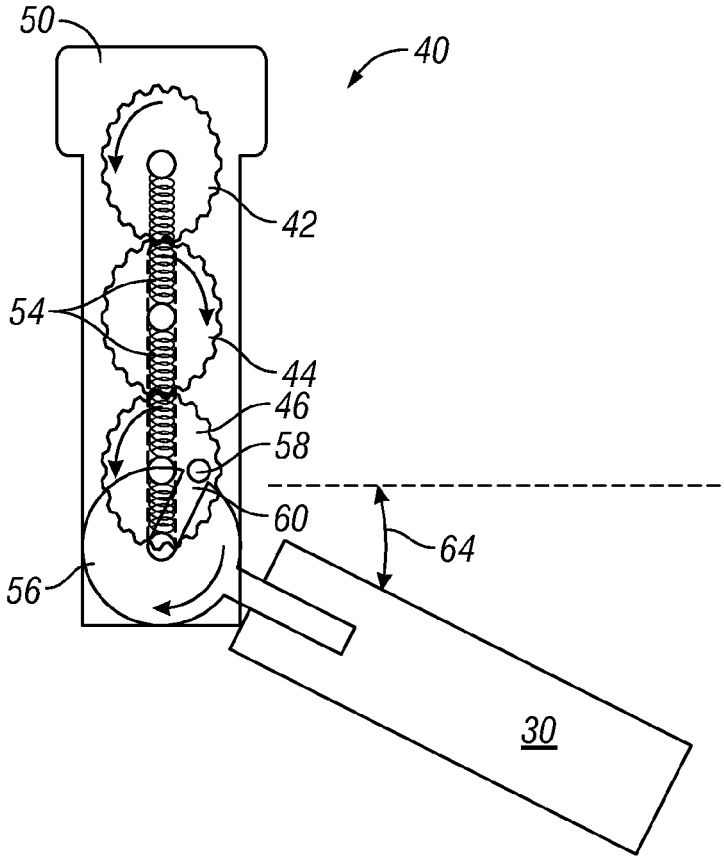
FIG. 2B is an enlarged view of the first hinge according to a preferred embodiment with the door opened to a slight angle.
Figure 1C:
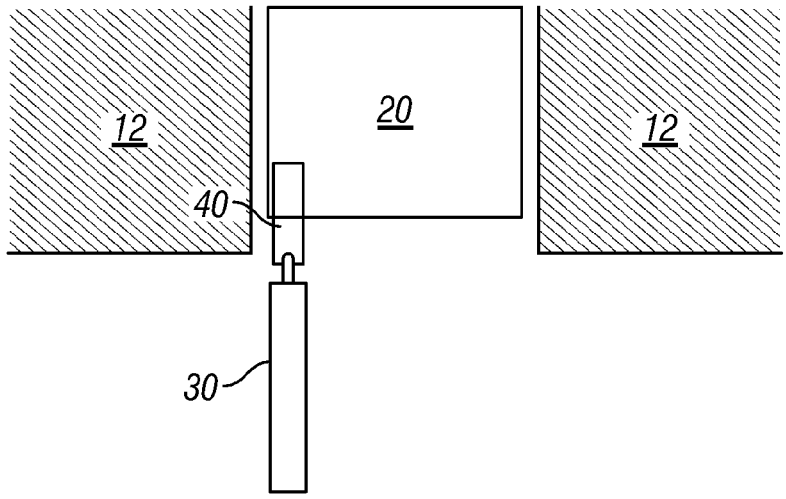
FIG. 1C is a top down view of the refrigerator with the door in a fully open position.
Figure 2C:
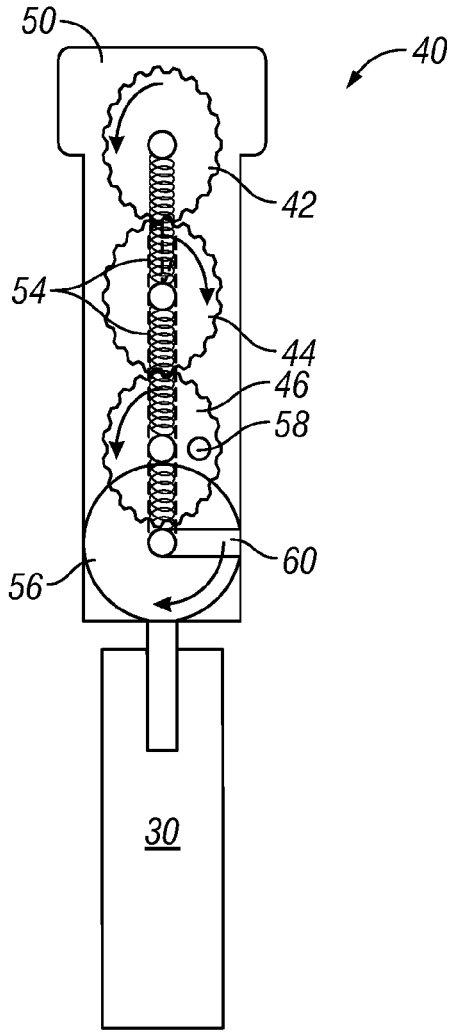
FIG. 2C is an enlarged view of the first hinge with the door fully opened.

A first embodiment of this invention is shown in FIGS. 1A-1C and 2A-2C. FIGS. 1A-1C show the refrigerator door being opened to various angles, while FIGS. 2A-2C show the orientation of the hinge components as the door is opened. FIG. 1A shows the refrigerator 10 with the door 30 in a closed position, the door 30 being flush to the outer surface of the cabinets 12. The door 30 is connected to the fresh food compartment 20 by a hinge 40. FIG. 2A shows the orientation of the various elements of the hinge 40 when the door is in the closed position. The three elliptical hinges 42, 44, 46 are arranged such that the minimum distance between the three centers 48 is achieved. Further, the timing gear 56 to which the door 30 is coupled is in a position such that slot 60 interacts with pin 58. Springs 54 are in a relaxed position.

As shown in FIGS. 2A-C, the timing gear 56 preferably is a Geneva mechanism. This type of timing gear is characterized by a slot 60 extending radially away from the center of the timing gear 56 and a pin 58 on an adjacent gear 46. As the timing gear 56 rotates, the slot 60 contacts the pin 58, rotating the adjacent gear 46. Once the timing gear 56 has reached a predetermined angle, the slot 60 no longer contacts the pin 58, allowing the two gears to rotate independently of one another. Other alternative timing gears are contemplated by this invention. The timing gear may be a mutilated gear, having teeth only about a portion of its perimeter. Any known device for producing intermittent rotary motion would satisfy the requirement for performing the invention.

FIG. 1B shows the refrigerator door 30 open to a partially open angle 64 causing the hinge 40 to expand. FIG. 2B shows the orientation of the elements of hinge 40 at this angle 64. The door 30 has been opened to an angle 64 causing the timing gear 56 to rotate clockwise. As the timing gear 56 rotates clockwise, the slot 60 acts on pin 58 to cause the third elliptical gear 46 to rotate counterclockwise. As gear 46 rotates, its teeth 62 interact with the teeth on the second gear 44 causing it to rotate clockwise which in turn causes the first elliptical gear 42 to rotate counterclockwise. As these gears rotate, their elliptical shape causes them to displace one another along the path 52 in the base member 50. Springs 54 ensure that the gears 42, 44, 46, 56 remain in contact.

As further shown in FIG. 2B, when the hinge 40 is at its maximum extended position, springs 54 provide maximum tension between the gears.

FIG. 1C shows the refrigerator door 30 in a maximum open position with hinge 40 fully extended. When the door 30 is in a fully open position, as shown in FIG. 1C, the door 30 has translated away from the fresh food compartment 20 and rotated about the hinge 40 to fully expose the fresh food compartment 20. The translation of the door 20 allows it to open without contacting the adjacent cabinets 12. As shown in FIG. 2C at this position, the slot 60 on the timing gear 56 is no longer interacting with the pin 58. The refrigerator door is thereby free to rotate about the center of the timing gear 56. As the refrigerator door closes, the slot 60 on the timing gear 56 will interact with the pin 58 and, upon closing, return the elliptical gears 42, 44, 46 to their original position as the springs 54 maintain contact between the gears.

The type, shape and number of the gears may vary according to preference. For example, the first 42, second 44, and third 46 gears may be either toothed about their perimeter or may be mutilated gears, having teeth only about a portion of their perimeter. Also, the gears need not be elliptical, any noncircular gear having a variable radius may be used. Additionally, circular gears rotating about a non-centralized point may be used. Any combination of gears which displace one another while rotating is contemplated by the invention.

The type and number of springs 54 may also vary according to the particular needs of the manufacturer. The number and type of springs 56 will generally relate to the number and type of gears. Traditional tension springs have a zero or minimum distance between coils at a released position will be the preferred type. Other devices, such as bands, rotary springs, cams, and other devices commonly known in the art may be used to ensure continuous contact between pairs of gears.

The hinge 40 may also incorporate a means by which the door 30 may be held open at a variety of positions. One or more of the gears may feature a gravity closing cam, a deformed gear, or other like means by which door 30 may be held at a variety of open positions.

Other features common to refrigerator doors, as known in the art, may also be included. Some of these features include, but are not limited to: dampers to slow or reduce the door opening or closing speed; auto-closing features, such as a gravity biased cam; a door stop to limit the extend the door may be opened; or any other features common to refrigerator doors.

Figure 3A:
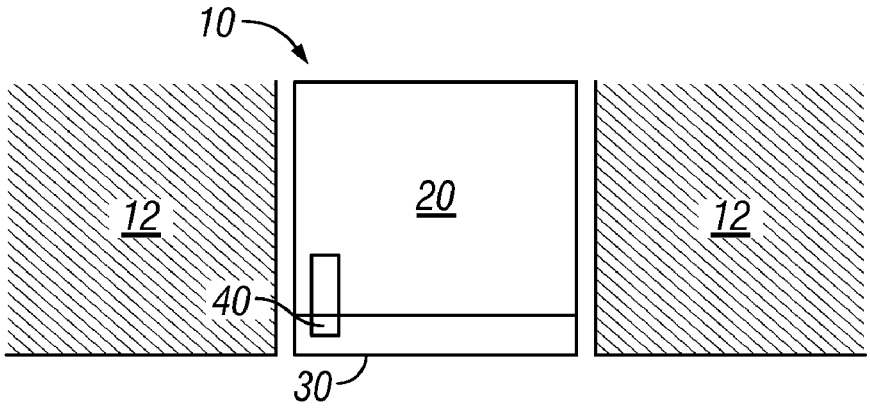
FIG. 3A is a top down view of the refrigerator with a second hinge design showing the door mounted flush with the cabinets.
Figure 4A:
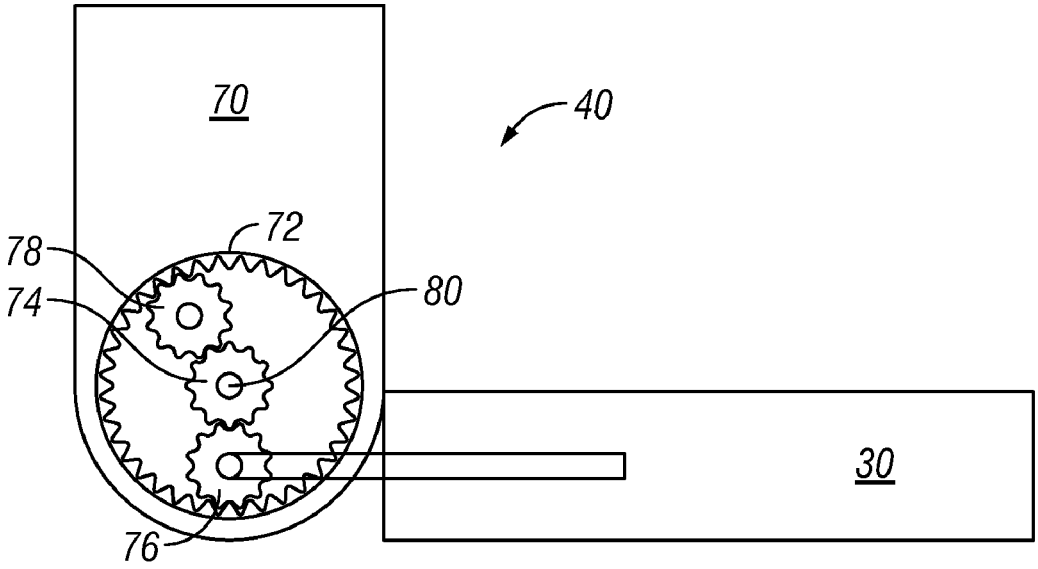
FIG. 4A is an enlarged view of the second hinge showing the door in a closed position.
Figure 3B:
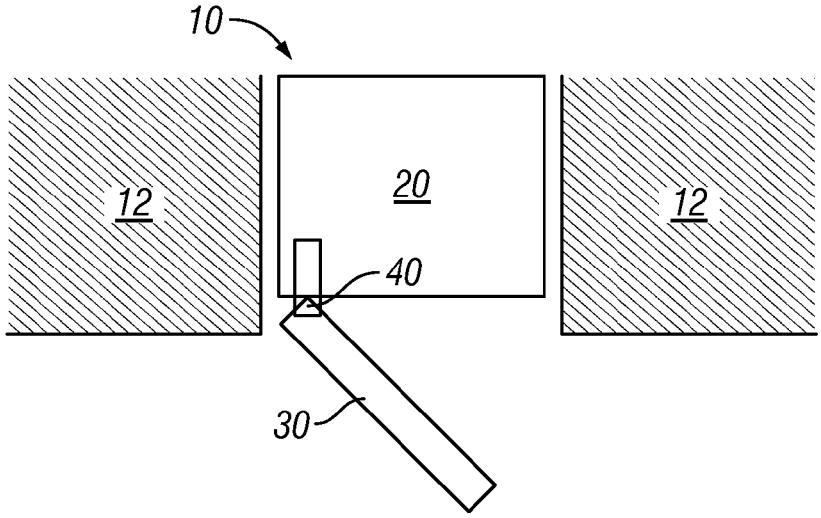
FIG. 3B is a top down view of the refrigerator showing the door partially open.
Figure 4B:
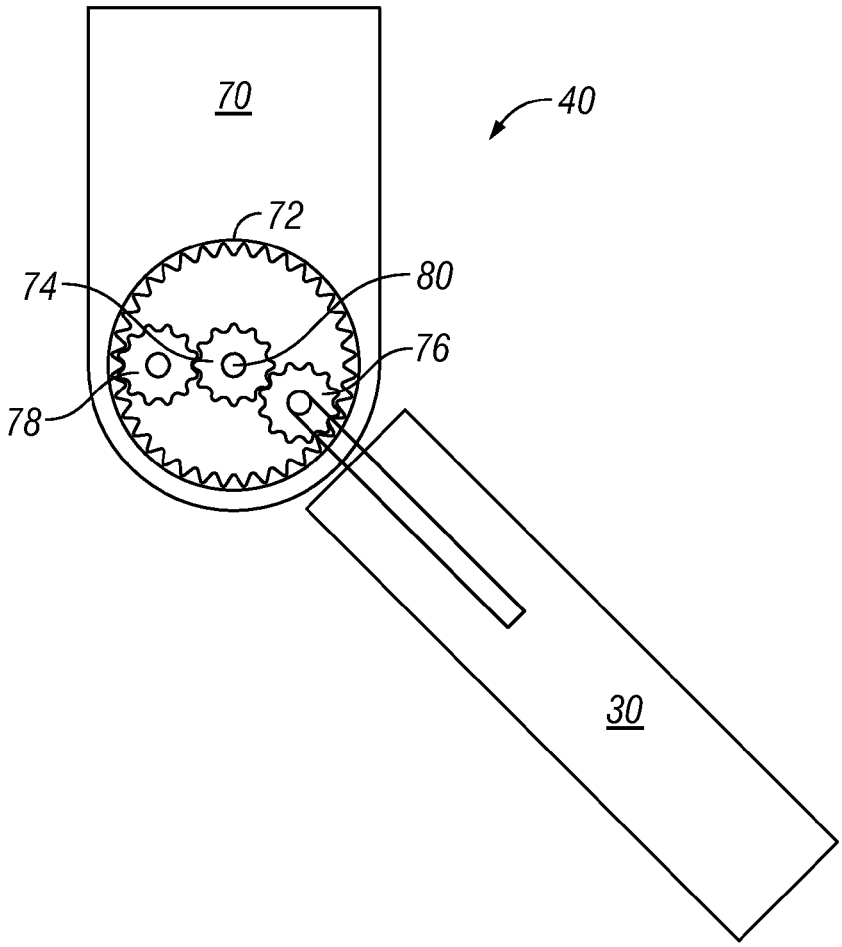
FIG. 4B is an enlarged view of the second hinge showing the door partially open.
Figure 3C:
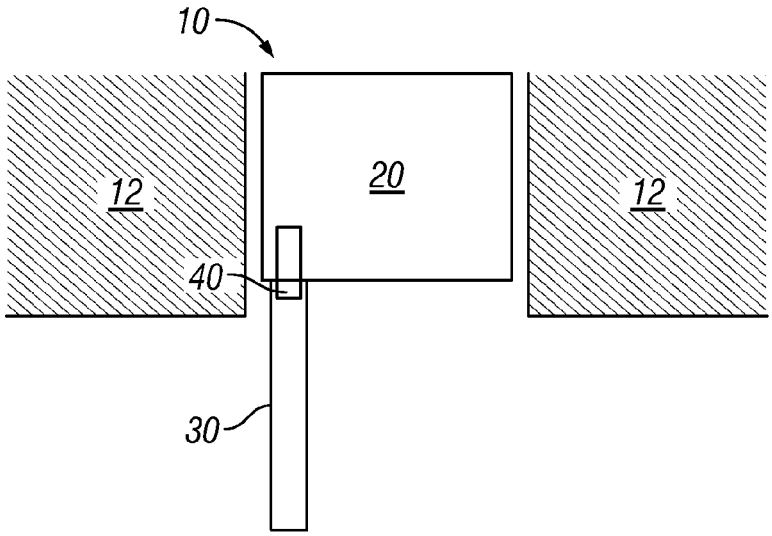
FIG. 3C is a top down view of the refrigerator showing the door fully open.
Figure 4C:
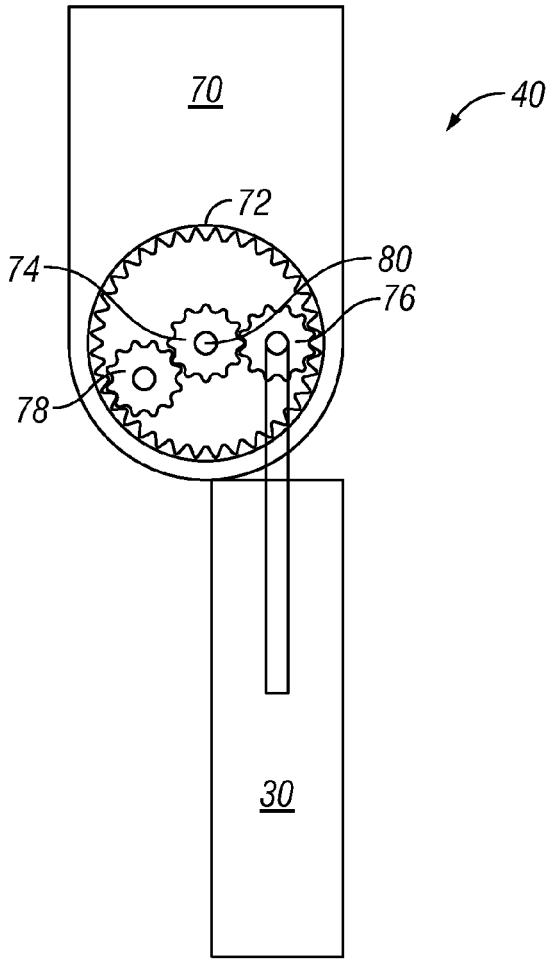
FIG. 4C is an enlarged view of the second hinge showing the door in a fully open position.

An alternative embodiment is shown in FIGS. 3A-3C and 4A-4C. FIGS. 3A-3C show the refrigerator 10 positioned flush between cabinets 12. The door 30 is shown at various states of opening. FIGS. 4A-4C show the hinge 40 of the refrigerator 10 as the door 30 is opened to various positions as shown in the corresponding FIGS. 3A-3C. As shown in FIG. 4A, the hinge 40 has a support member 70 with an annulus or gear housing 72 cut through the support member. The support member 70 is secured to the fresh food compartment 20. A center gear 74, sharing a center point with the annulus 72, is free to rotate about its axis 80, the axis being preferably attached to the fresh food compartment 20. A door gear 76 and an offset gear 78 are positioned in contact with and between the center gear 74 and the annulus 72 and are free to rotate and translate relative to the fresh food compartment 20. The door gear 76 is attached to the door 30 such that movement of one is transferred to the other. Because door gear 76 is constrained to move in a predetermined path, the opening path of door 30 can be controlled.

FIG. 3B shows the refrigerator 10 with the door 30 open to an intermediate position. As shown in FIG. 4B, as the refrigerator door 30 is opened, it causes door gear 76 to rotate. Center gear 74 forces door gear 76 to translate about an arc centered at the axis 80. As shown in FIGS. 3B and 4B, the door 30 translates away from the adjacent cabinets 12, thereby eliminating the potential for damaging the adjacent cabinets 12. FIGS. 3C and 4C show the refrigerator in a fully opened position. As shown in FIG. 3C, the refrigerator door 30 has rotated about the hinge 40 and translated away from the cabinets 12. As shown in FIG. 4C with the door 30 opened to a fully opened position, door gear 76 has fully translated about the arc centered on the axis 80 and the door gear 76 has rotated as the door 30 was opened. As the door 30 is closed, the door gear 76 rotates back to its original position and translates back along the arc centered at the axis 80.

The above described apparatus produces hypocycloidic motion of the door hinge, although a number of circular or noncircular gears in a planetary arrangement may be used according to the present invention. The annulus 72 may be either a complete or a partial gear, the partial gear allowing the door to be stopped at a predetermined opening. The offset gear 78 prevents unbalanced forces, and may be either a single gear, or any number of gears. Also, the offset gear 78 may be omitted from the hinge 40 as a cost-saving measure.

Preferably, the hinge includes a gear casing. The gear casing enclosed the moving parts of the gear and provides support for the refrigerator door. By supporting the refrigerator door's weight on the gear casing, the moving parts of the hinge will less likely to suffer mechanical failure or prematurely wear. The gear casing also features a slot corresponding to the path of the hinge pin. The door would rest adjacent this slot on a washer, bearing, or other surface. Preferably, the interaction between the door and gear casing has a low friction, allowing the door to easily open by a consumer.

In certain circumstances, the door may twist or deform as the door is opened. Because the top and bottom hinges do not rotate about a fixed hinge, and move separate from one another, there is a chance for the door to become stuck if the door should deform. Therefore, a support rod located inside the door, extending from the top to the bottom of the door, may also be used. The support rod prevents twisting or deformation of the refrigerator door between the hinges, ensuring the top and bottom hinges remain in line and allowing the door to open smoothly.

The above described embodiment of the present invention may be further improved through the use of cams to assist in gravity closing of the door, dampers to slow the opening and closing speed of the refrigerator door, or notches to cause the door to remain open at selected angles. Further improvements may be made to the above-described embodiments as known by those skilled in the art, such as the improvements suggested for the previous embodiment.

The above described embodiments of the present invention may be used on any type of refrigerator as will be recognized by those in the art. Any refrigerator having a door, whether French doors, freezer on top, side-by-side, or other style, the present invention may be incorporated into the design.

The above-described embodiments are for illustrative purposes only and do not limit the scope of the claimed invention. The invention is only to be limited by the claims of the patent.

What is claimed is:

1. A refrigerator comprising:

a cabinet:

a door connected by a hinge to the cabinet;

said hinge comprising:

(a) a plurality of gears, each gear rotatable about a point and at least one gear mounted so as to translate away from said cabinet as it rotates; and (b) a timing gear in contact with said at least one gear for rotating said door relative to said cabinet after said at least one gear has translated away from said cabinet:

(c) wherein said timing gear is a Geneva mechanism.

2. The refrigerator of claim 1 wherein each of said plurality of gears are noncircular gears.

3. The refrigerator of claim 2 wherein said hinge further comprises a plurality of springs biased to maintain contact between said gears.

4. The refrigerator of claim 2 wherein said noncircular gears are held in contact with one another by a plurality of springs.

5. The refrigerator of 2 wherein said noncircular gears are mutilated gears.

6. The refrigerator of claim 1 wherein each of the plurality of gears is a mutilated gear.

7. The refrigerator of claim 1 wherein each of said plurality of gears are elliptical gears.

8. The refrigerator of claim 1 wherein each of said plurality of gears have an elliptical shape.

9. The refrigerator of claim 1 further comprising a gear housing.

10. The refrigerator of claim 9 wherein said gear housing supports the weight of said door.

11. A refrigerator, comprising:

a cabinet:

a refrigerator compartment disposed within the cabinet:

a door providing access to the refrigerator compartment: and a hinge, said hinge comprising:

(a) a base member attached to said refrigerator compartment;

(b) at least one noncircular gear mounted to said base member; and (c) a timing gear in contact with said noncircular gear and slideably mounted to said base member, said timing gear attached to said door:

wherein the timing gear comprises a Geneva mechanism.

12. The refrigerator of claim 11 wherein said at least one noncircular gear translates away from said cabinet as said at least one noncircular gear rotates.

13. The refrigerator of claim 12 wherein said base member comprises a slot along which said at least one noncircular gear translates.

14. The refrigerator of claim 1 wherein said hinge further comprises a plurality of springs adapted to ensure contact between said at least one noncircular gear and said timing gear.

15. The refrigerator of claim 1 wherein said noncircular gear is a mutilated gear.

16. The refrigerator of claim 11 wherein said noncircular gears are elliptical.

17. The refrigerator of claim 11 further comprising a gear housing.

18. The refrigerator of claim 17 wherein said gear housing supports the weight of said door.

19. A refrigerator comprising:

a refrigerator compartment:

a door attached to said refrigerator compartment by a hinge, said hinge comprising:

(a) a base member attached to said refrigerator compartment having an arm extending away from said refrigerator compartment;

(b) a first elliptical gear fixed to said arm and rotatable about a first axis;

(c) a second elliptical gear in contact with said first elliptical gear and rotatable about a second axis and slidably mounted to said arm;

(d) a third elliptical gear in contact with said second elliptical gear and rotatable about a third axis and slidably mounted to said arm;

(e) a timing gear in contact with said third elliptical gear and rotatable about a fourth axis and slidably mounted to said arm, said timing gear being further attached to said door such that motion of said timing gear is translated to said door.

20. The refrigerator of claim 19 wherein said hinge further comprises a plurality of springs connecting said first and second axes, said second and third axes, and said third and fourth axes, said springs biased in order to maintain contact between gears attached to said axes.

21. The refrigerator of claim 19 wherein said first, second, and third elliptical gears are mutilated gears having teeth only about a portion of said gears' perimeter.

22. The refrigerator of claim 19 wherein said timing gear is a Geneva mechanism, said third elliptical gear having a pin extending normal to the face of said third elliptical gear.

23. The refrigerator of claim 19 wherein said hinge further comprises a plurality of notches in said first, second, and third elliptical gears for propping said door open at various intervals.

24. The refrigerator of claim 19 wherein said first, second, and third axes are centered on said first, second, and third elliptical gears.

25. The refrigerator of claim 19 further comprising a gear housing.

26. The refrigerator of claim 25 wherein said gear housing supports the weight of said door.

* * * * *

UNITED STATES PATENT AND TRADEMARK OFFICE

CERTIFICATE OF CORRECTION

PATENT NO. : 8,186,781 B2
APPLICATION NO. : 12/437033
DATED : May 29, 2012
INVENTOR(S) : Joseph Lee Coleman et al.

It is certified that error appears in the above-identified patent and that said Letters Patent is hereby corrected as shown below:

Col. 5, lines 2-13, Claim 1: "A refrigerator comprising: a cabinet: a door connected by a hinge to the cabinet; said hinge comprising: (a) a plurality of gears, each gear rotatable about a point and at least one gear mounted so as to translate away from said cabinet as it rotates; and (b) a timing gear in contact with said at least one gear for rotating said door relative to said cabinet after said at least one gear has translated away from said cabinet: (c) wherein said timing gear is a Geneva mechanism."
should be
Claim 1: --A refrigerator comprising: a cabinet; a door connected by a hinge to the cabinet; said hinge comprising: (a) a plurality of gears, each gear rotatable about a point and at least one gear mounted so as to translate away from said cabinet as it rotates; and (b) a timing gear in contact with said at least one gear for rotating said door relative to said cabinet after said at least one gear has translated away from said cabinet; (c) wherein said timing gear is a Geneva mechanism.--

Col. 5, lines 22-23, Claim 5: "The refrigerator of 2 wherein said noncircular gears are mutilated gears."
should be
Claim 5: --The refrigerator of claim 2 wherein said noncircular gears are mutilated gears.--

Col. 5, lines 34-48, Claim 11: "A refrigerator, comprising: a cabinet: a refrigerator compartment disposed within the cabinet: a door providing access to the refrigerator compartment: and a hinge, said hinge comprising: (a) a base member attached to said refrigerator compartment; (b) at least one noncircular gear mounted to said base member; and (c) a timing gear in contact with said noncircular gear and slideably mounted to said base member, said timing gear attached to said door: wherein the timing gear comprises a Geneva mechanism."
should be
Claim 11: --A refrigerator, comprising: a cabinet; a refrigerator compartment disposed within the cabinet; a door providing access to the refrigerator compartment; and a hinge, said hinge comprising: (a) a base member attached to said refrigerator compartment; (b) at least one noncircular gear mounted to said base member; and (c) a timing gear in contact with said noncircular gear and slideably mounted to said base member, said timing gear attached to said door; wherein the timing gear comprises a Signed and Sealed this
Fourth Day of September, 2012

David J. Kappos
*Director of the United States Patent and Trademark Office*

Geneva mechanism.--

Col. 6, lines 1-4, Claim 14: "The refrigerator of claim 1 wherein said hinge further comprises a plurality of springs adapted to ensure contact between said at least one noncircular gear and said timing gear."
should be
Claim 14: --The refrigerator of claim 11 wherein said hinge further comprises a plurality of springs adapted to ensure contact between said at least one noncircular gear and said timing gear.--

Col. 6, lines 5-6, Claim 15: "The refrigerator of claim 1 wherein said noncircular gear is a mutilated gear."
should be
Claim 15: --The refrigerator of claim 11 wherein said noncircular gear is a mutilated gear.--

Col. 6, lines 13-31, Claim 19: "A refrigerator comprising: a refrigerator compartment: a door attached to said refrigerator compartment by a hinge, said hinge comprising: (a) a base member attached to said refrigerator compartment having an arm extending away from said refrigerator compartment; (b) a first elliptical gear fixed to said arm and rotatable about a first axis; (c) a second elliptical gear in contact with said first elliptical gear and rotatable about a second axis and slidably mounted to said arm; (d) a third elliptical gear in contact with said second elliptical gear and rotatable about a third axis and slidably mounted to said arm; (e) a timing gear in contact with said third elliptical gear and rotatable about a fourth axis and slidably mounted to said arm, said timing gear being further attached to said door such that motion of said timing gear is translated to said door."
should be
Claim 19: --A refrigerator comprising: a refrigerator compartment; a door attached to said refrigerator compartment by a hinge, said hinge comprising: (a) a base member attached to said refrigerator compartment having an arm extending away from said refrigerator compartment; (b) a first elliptical gear fixed to said arm and rotatable about a first axis; (c) a second elliptical gear in contact with said first elliptical gear and rotatable about a second axis and slidably mounted to said arm; (d) a third elliptical gear in contact with said second elliptical gear and rotatable about a third axis and slidably mounted to said arm; (e) a timing gear in contact with said third elliptical gear and rotatable about a fourth axis and slidably mounted to said arm, said timing gear being further attached to said door such that motion of said timing gear is translated to said door.--